US010307770B2

(12) United States Patent
Hines et al.

(10) Patent No.: US 10,307,770 B2
(45) **Date of Patent: *Jun. 4, 2019**

(54) METHOD FOR THE BENIFICIATION OF COAL

(71) Applicant: INGEVITY SOUTH CAROLINA, LLC, North Charleston, SC (US)

(72) Inventors: John B. Hines, Atlanta, GA (US); Dennis L. Kennedy, Buford, GA (US); Phillip W. Hurd, Conyers, GA (US)

(73) Assignee: INGEVITY SOUTH CAROLINA, LLC, North Charleston, SC (US)

( * ) Notice: Subject to any disclaimer, the term of this patent is extended or adjusted under 35 U.S.C. 154(b) by 1173 days.

This patent is subject to a terminal disclaimer.

(21) Appl. No.: 14/585,378

(22) Filed: Dec. 30, 2014

(65) Prior Publication Data

US 2015/0108043 A1 Apr. 23, 2015

Related U.S. Application Data

(63) Continuation of application No. 12/353,997, filed on Jan. 15, 2009, now Pat. No. 8,925,729.

(60) Provisional application No. 61/021,203, filed on Jan. 15, 2008, provisional application No. 61/026,327, filed on Feb. 5, 2008.

(51) Int. Cl.
*B03D 1/02* (2006.01)
*B03D 1/008* (2006.01)
*B03D 1/004* (2006.01)

(52) U.S. Cl.
CPC ..... *B03D 1/023* (2013.01); *B03D 1/004* (2013.01); *B03D 1/008* (2013.01); *B03D 1/02* (2013.01); *B03D 2201/02* (2013.01); *B03D 2203/08* (2013.01)

(58) Field of Classification Search
CPC ..... B03D 1/023; B03D 1/02; B03D 1/008; B03D 1/004; B03D 2203/08; B03D 2201/02
USPC ..... 209/166
See application file for complete search history.

(56) References Cited

U.S. PATENT DOCUMENTS 1,585,756 A 5/1926 Borcherdt
2,303,931 A * 12/1942 Greene ..... B03D 1/008 209/166
2,591,885 A 4/1952 Smith
2,713,420 A 7/1955 Lord
2,728,682 A 12/1955 Kalinowski et al.
2,803,345 A 8/1957 Hutchinson Jacobs
2,831,574 A * 4/1958 Weinig ..... B03D 1/008 209/166
2,894,880 A 7/1959 Sisson et al.
2,931,574 A * 4/1960 Zuiderhoek ..... B64D 13/00 236/1 C
3,030,219 A 4/1962 Clark
3,067,875 A * 12/1962 Fenske ..... B03D 1/008 209/166
3,252,937 A 5/1966 Giulio et al.
3,277,001 A 10/1966 Maly et al.
3,814,789 A 6/1974 Cox
4,253,994 A 3/1981 Hefner, Jr.
4,271,066 A 6/1981 Matsuo et al.
4,305,815 A 12/1981 Hefner, Jr.
4,330,339 A 5/1982 Nimerick
4,410,431 A 10/1983 Roe
4,415,337 A 11/1983 Kutta et al.
4,419,252 A 12/1983 Shim
4,447,344 A 5/1984 Roe
4,474,619 A 10/1984 Meyer et al.
4,507,198 A * 3/1985 Unger ..... B03D 1/008 209/166
4,504,385 A 6/1985 Keys
4,528,107 A 7/1985 McCaffrey et al.
4,589,980 A 5/1986 Keys
4,678,562 A 7/1987 Keys
4,701,257 A 10/1987 Hefner, Jr.
4,732,669 A 3/1988 Nimerick
4,756,823 A 7/1988 O'Neill et al.
4,770,766 A 9/1988 Keller, Jr. et al.
4,957,511 A 9/1990 Ljusberg-Wahren
4,968,415 A * 11/1990 Morawietz ..... B03D 1/008 209/166
5,346,630 A 9/1994 Kenney
5,379,902 A 1/1995 Wen et al.
5,443,158 A 8/1995 McKenny et al.
(Continued)

FOREIGN PATENT DOCUMENTS

GB 2093735 A 9/1982
GB 2163975 A 3/1986
(Continued)

OTHER PUBLICATIONS

Norlin et al. "Ullmann's Encyclopedia of Industrial Chemistry" [Online]. Jun. 15, 2000, 14 pages, John Wiley & Sons, Inc., Retrieved from the Internet: URL: http://mrw.interscience.wiley.com/emrw/9783527306732/ueic/article/a26_057/current/pdf?hd%3DA11%2Ctall&hd%3DA11%2Coil.
Sis et al., "Comparison of non-ionic and ionic collectors in the flotation of coal fines", Minerals Engineering, Apr. 2003, pp. 399-401, vol. 16, No. 4.
Sis et al., "Utilization of Fine Coal Tailings by Flotation Using Ionic Reagents", Energy Sources, Aug. 10, 2004, pp. 941-949, vol. 26, No. 10, Taylor & Francis Inc., United States of America.
(Continued)

*Primary Examiner* — Thomas M Lithgow
(74) *Attorney, Agent, or Firm* — Bryan D. Zerhusen, Esq.; Cantor Colburn LLP

(57) ABSTRACT

The present invention relates to the beneficiation of coal by the process of froth flotation and specifically relates to a process for the froth flotation of coal using a mixture of fatty acids and rosin acids (and/or certain derivatives of fatty acids and rosin acids) as a collector.

20 Claims, No Drawings

(56) References Cited

U.S. PATENT DOCUMENTS

| | | | | |
|---|---|---|---|---|
| 5,545,351 | A | 8/1996 | Riggs et al. | |
| 5,670,056 | A | 9/1997 | Yoon et al. | |
| 6,375,853 | B1 | 4/2002 | Yoon | |
| 6,526,675 | B1 | 3/2003 | Yoon | |
| 8,925,729 | B2 * | 1/2015 | Hines | B03D 1/008 209/166 |
| 2003/0146134 | A1 | 8/2003 | Yoon | |
| 2005/0269248 | A1 | 12/2005 | Cameron et al. | |
| 2007/0187301 | A1 | 8/2007 | Tran et al. | |
| 2011/0054098 | A1 | 3/2011 | Tutin et al. | |
| 2013/0041167 | A1 | 2/2013 | Kiviranta et al. | |

FOREIGN PATENT DOCUMENTS

| | | | |
|---|---|---|---|
| WO | 00/02662 | A | 1/2000 |
| WO | 2004/098782 | A | 11/2004 |
| WO | 2006086443 | A | 8/2006 |

OTHER PUBLICATIONS

PCT International Search Report and Written Opinion of the International Searching Authority for PCT/US2009/031036, dated Apr. 2, 2009, 10 pages.

PCT International Search Report and Written Opinion of the International Searching Authority for PCT/US2009/031035, dated Apr. 7, 2009, 10 pages.

Groppo, J.G. et al., "Surface Chemical Control of Ultra-Fine Coal to Improve Dewatering," Coal Preparation, 1996, pp. 103-116, vol. 17, Overseas Publishers Association, Amsterdam, Netherlands.

Singh, B.P., "The Influence of Surface Phenomena on the Dewatering of Fine Clean Coal," Filtration and Separation, Mar. 1997, pp. 159-163.

Georgia-Pacific Chemicals LLC, Material Safety Data Sheet for XTOL® 0530 Rosin Fortified Distilled Tall Oil, effective date Oct. 30, 1997, six pages.

Georgia-Pacific Chemicals LLC, Material Safety Data Sheet for XTOL® 3030 Tall Oil Distillation Bottoms, effective date Nov. 11, 1997, seven pages.

Georgia-Pacific Chemicals LLC, Material Safety Data Sheet for LYTOR® 100 Tall Oil Resin, effective date Jan. 22, 2001, seven pages.

Georgia-Pacific Chemicals LLC, Material Safety Data Sheet for XTOLUBE® 1305 Lubricant Additive, effective May 2, 2001, six pages.

Georgia-Pacific Chemicals LLC, Material Safety Data Sheet for XTOLUBE® 1317 Lubricant Additive, effective Feb. 27, 2001, six pages.

Georgia-Pacific Chemicals LLC, Material Safety Data Sheet for XTOLUBE® 1320 Lubricant Additive, effective May 2, 2001, six pages.

Georgia-Pacific Chemicals LLC, Material Safety Data Sheet for XTOL® 0520 Distilled Tall Oil, effective date Dec. 9, 2004, seven pages.

Georgia-Pacific Chemicals LLC, Material Safety Data Sheet for XTOL® 656 Mixed Tall Oil Acids, effective date Aug. 31, 2005, seven pages.

Georgia-Pacific Chemicals LLC, Material Safety Data Sheet for GP® 678G38 Mining Solvent, effective date Sep. 27, 2007, six pages.

Georgia-Pacific Chemicals LLC, Material Safety Data Sheet for XTOL® 304 Tall Oil Fatty Acids, effective date Apr. 4, 2008, six pages.

Georgia-Pacific Chemicals LLC, Material Safety Data Sheet for XTOL® 101 Tall Oil Fatty Acids, effective date Apr. 14, 2008, six pages.

Georgia-Pacific Chemicals LLC, Material Safety Data Sheet for XTOL® 100 Tall Oil Fatty Acids, effective date Apr. 14, 2008, six pages.

Georgia-Pacific Chemicals LLC, Material Safety Data Sheet for XTOL® 300 Tall Oil Fatty Acids, effective date Apr. 14, 2008, six pages.

* cited by examiner

METHOD FOR THE BENIFICIATION OF COAL

CROSS-REFERENCE TO RELATED APPLICATION

This application is a continuation of co-pending U.S. patent application Ser. No. 12/353,997, filed on Jan. 15, 2009, which claims priority to U.S. Provisional Patent Application Nos. 61/021,203, filed on Jan. 15, 2008, and 61/026,327, filed on Feb. 5, 2008, all of which are incorporated by reference herein.

FIELD OF THE INVENTION

The present invention relates to the beneficiation of coal by the process of froth flotation and specifically relates to a process for the froth flotation of coal using a mixture of fatty acids and rosin acids (or certain derivatives of fatty acids and rosin acids) as a collector.

BACKGROUND OF THE INVENTION

Most coals inherently contain some non-combustible mineral matter (reported as the ash value of the coal) that exists in close association with the combustible carbonaceous solids. In order to improve the value of such coals, such as the combustion value, it is necessary to remove as much of this mineral matter as possible. This beneficiation can be accomplished by finely dividing the coal and separating combustible coal particles from mineral-containing particles. Froth flotation is a common method used to beneficiate finely-divided coals. Conventional techniques involve the passage of air through a suspension of the finely-divided coal to create finely disseminated air bubbles which creates a froth and preferentially carries the carbonaceous coal particles to the surface.

Since the surface of coal is generally hydrophobic, it is possible to preferentially float finely divided coal particles from finely divided mineral matter (recovered in the tails) in the presence of a frothing agent, such as methyl isobutyl carbinol. In this way the combustion value of the finely-divided coal can be improved. Unfortunately, many coals have experienced some degree of surface oxidation, such as oxidized bituminous coals, which reduces the hydrophobicity of their surface and interferes with their ability to float. As a result, in the absence of any treatment to improve surface hydrophobicity of such coals, the tail fraction from the flotation may contain a significant fraction of combustible material, thus reducing flotation yield.

Substances used to enhance surface hydrophobicity and improve the yield of a coal flotation are known as collectors. Collectors are generally surface active reagents which preferentially wet or adsorb on coal surfaces. Water insoluble, neutral hydrocarbon liquids derived from petroleum, wood, or coal tars have usually been employed in the froth flotation of coal. Historically, a number of fuel oils have been used as collectors, such as diesel oil, kerosene, furnace oil, Bunker C fuel oil, and mixtures thereof to enhance the surface hydrophobicity of the combustible coal particles. In this way, the yield of reduced ash coal may be significantly improved.

Recently, conventional coal beneficiation practices have come under heightened environmental scrutiny. It has long been the practice of coal treatment facilities to discharge the recovered tailings by landfill. Unfortunately, the most commonly used fuel oil collectors are not environmentally friendly and regulations and/or legislation limiting or possibly prohibiting their use is anticipated.

As a result, efforts are underway to find more environmentally acceptable materials that will function effectively as collectors, i.e., that promote the flotation of the combustible coal particles in preference to the non-combustible mineral particles, in the established processes of beneficiating coal by froth flotation.

DETAILED DESCRIPTION OF THE INVENTION

The present invention provides a more environmentally friendly method for beneficiating coal by froth flotation. In particular, the present invention provides a process of froth flotation wherein an aqueous coal slurry is mixed with a collector consisting essentially of a mixture of a fatty acid component and a rosin acid component (including fatty acids and rosin acids and certain derivatives of fatty acids and rosin acids) and the combustible coal particles in the coal slurry are preferentially floated.

In particular, in one embodiment, the present invention provides a froth flotation process for the beneficiation of coal, which process comprises the steps of (a) forming an aqueous slurry of the coal, (b) adding an effective amount of a collector consisting essentially of a mixture of (1) a fatty acid component comprising fatty acids, fatty acid derivatives, or a mixture thereof and (2) a rosin acid component comprising rosin acids, rosin acid derivatives, or a mixture thereof, (c) subjecting the aqueous slurry of coal containing the collector to froth flotation, and (d) separating the floated material comprising the beneficiated coal.

In one embodiment, the present invention provides a froth flotation process for the beneficiation of coal, which process comprises the steps of (a) forming an aqueous slurry of the coal, (b) adding an effective amount of a collector consisting essentially of a mixture of (1) a fatty acid component comprising fatty acids, fatty acid derivatives, or a mixture thereof and (2) a rosin acid component comprising rosin acids, rosin acid derivatives, or a mixture thereof, where fatty acid component (1) constitutes 25 to 90% by weight of the mixture; rosin acid component (2) constitutes 5 to 65% by weight of the mixture and the collector contains less than 18% of other non-fuel oil components, (c) subjecting the aqueous slurry of coal containing the collector to froth flotation, and (d) separating the floated material comprising the beneficiated coal.

In another embodiment, the present invention is directed to a froth flotation process for the beneficiation of coal, which process comprises the steps of (a) forming an aqueous slurry of coal particles, (b) adding an effective amount of a collector consisting essentially of a crude tall oil or a crude tall oil equivalent to the aqueous slurry of coal, (c) subjecting the aqueous slurry of coal containing the collector to froth flotation, and (d) separating the floated material comprising the beneficiated coal.

Testing conducted by applicants has demonstrated that the collectors of the present invention are for the most part at least comparable to, and may in many instances be superior to conventional, less environmentally acceptable fuel oil collectors previously used in this froth flotation application, i.e., in the froth flotation of coal. Since the collectors used in accordance with the present invention do not pose an environmental hazard, they provide an environmentally friendly alternative to the conventional fuel oil collectors.

By requiring that the collector "consist essentially of" ("consisting essentially of") a mixture of fatty acids and rosin acids (or certain derivatives of fatty acids and rosin acids), such as a crude tall oil or a crude tall oil equivalent, applicants intend to exclude the concomitant use of fuel oil as a co-collector in the froth flotation method. If fuel oil is also included in the aqueous coal slurry, one destroys the environmental advantage inherent in the use of the disclosed fatty acid and rosin acid materials. Stated in another manner, by including a fuel oil as part of the collector or by adding a fuel oil during the beneficiation process, the basic and novel characteristics of the environmentally friendly collector of the present invention is compromised.

Fatty acids useful as one of the components of the collector of the present invention include aliphatic $C_8$ to $C_{22}$ carboxylic acids that can be obtained from a variety of sources. Representative fatty acids include oleic acid, lauric acid, linoleic acid, linolenic acid, palmitic acid, stearic acid, riccinoleic acid, myristic acid, arachidic acid, behenic acid and mixtures thereof. Through the use of known saponification techniques, a number of vegetable oils, such as linseed (flaxseed) oil, castor oil, tung oil, soybean oil, cottonseed oil, olive oil, canola oil, corn oil, sunflower seed oil, peanut oil, coconut oil, safflower oil, palm oil and mixtures thereof, to name just a few, can be used as a source of the fatty acid component of the collector of the present invention. One preferred source of fatty acids is tall oil. One particular source of such preferred fatty acid is distilled tall oil containing no more than about 1% rosin acid and other constituents and referred to as TOFA (Tall Oil Fatty Acid).

As is known in the art, crude tall oil refers to the resinous yellow-black oily liquid obtained as an acidified byproduct in the Kraft or sulfate processing of pine (coniferous) wood. The black liquor produced in connection with such papermaking processes is concentrated and then allowed to settle. A tall oil soap collects at the surface of the settling, concentrated black liquor. This tall oil soap is recovered and acidified, usually using sulfuric acid. The acidified mixture is referred to as crude tall oil. Thus, crude tall oil (CTO), prior to refining, is normally a mixture of three components rosin or resin acids, fatty acids, and a variety of neutral or non-saponifiable extractives, including sterols, high-molecular weight alcohols, and other alkyl (hydrocarbon) chain materials that cannot be saponified (neutral components). Distillation of crude tall oil is often used to recover a mixture of fatty acids in the $C_{16}$-$C_{20}$ range. The commercially available tall oil products XTOL®100, XTOL®300, and XTOL®304 (all from Georgia-Pacific Chemicals LLC, Atlanta, Ga.), for example, all contain saturated and unsaturated fatty acids in the $C_{16}$-$C_{18}$ range, as well as minor amounts of rosin acids.

The main fatty acids in crude tall oil are oleic acid, linoleic acid and palmitic acid. The principle rosin or resin acids are abietic acid, dehydroabietic acid, isopimaric acid and pimaric acid. The neutral fraction contains a variety of hydrocarbons, higher alcohols and sterols.

As recognized by those skilled in tall oil chemistry, the actual distribution of these three major constituents in a crude tall oil depends on a variety of factors, such as the particular coniferous species of the wood being processed (wood type), the geographical location of the wood source, the age of the wood, the particular season that the wood is harvested, and others. Thus, depending on the particular source, crude tall oil can contain from about 20-75% fatty acids (more often 30-60%), from about 20-65% rosin acids (more often 30-60%) and the balance being the neutral and non-saponifiable components, but crude tall oil usually contains at least about 5% neutral and non-saponifiable components (all percents being by weight). Usually, crude tall oil contains at least 8% by weight neutral and non-saponifiable components and often 10% by weight or higher neutral and non-saponifiable components.

In its normal processing, crude tall oil is exposed to a series of distillation operations to produce a variety of products, such as a stream enriched in the fatty acids (TOFA or tall oil fatty acids), which constitutes one of the more valuable fractions of CTO; a stream enriched in the rosin acids (TORA or tall oil rosin acids); an intermediate fraction that contains a mixture of the various components and is generally identified as distilled tall oil (DTO), and pitch which is typically the bottom of the distillation. Distilled tall oil is tall oil which has been subjected to initial distillation to remove tall oil pitch. Distilled tall oil is a mixture of fatty acids, fatty acid esters, rosin and rosin esters. During the distillation of crude tall oil, most of the sterols and high molecular weight alcohols remain in the tall oil pitch fraction.

In addition to the fatty acids themselves, the process of the present invention also contemplates the use of certain fatty acid derivatives. In particular, fatty acid monoesters and diesters with polyhydric alcohols can be substituted in whole, or in part, for the fatty acid component. Higher esters, such as the fatty acid triglycerides should not be included in any significant amount. Preferably, the polyhydric alcohols have a molecular weight of less than about 1000, preferably less than about 500 and particularly less than about 300. Through the use of known transesterification techniques, vegetable oils can be used to produce such fatty acid derivatives. As a result, the phrase "fatty acid and/or fatty acid derivatives" is intended to include fatty acids alone, mono- and di-esters of such fatty acids with polyhydric alcohols, particularly polyhydric alcohols having a molecular weight of less than about 1000, preferably less than about 500 and especially less than about 300, and mixtures of these acids and esters.

The other necessary component of the collector of the present invention is a rosin acid and/or a rosin acid derivative. Rosin acids also are found in tall oil and are believed to be derived from the oxidation and polymerization of terpenes in softwood, particularly conifers. The main rosin acid component of tall oil is abietic acid. Other significant rosin acid constituents include pimaric acid and isopimaric acid.

In addition to the rosin acids themselves, the process of the present invention also contemplates the use of rosin acid derivatives. One suitable rosin acid derivative is disproportionated rosin acids. In a disproportionated rosin acid, the conjugated double bonds of abietic acid are transformed by a disproportionation reaction. One method for disproportionating rosin acids is described in U.S. Pat. No. 4,271,066. Other suitable rosin acid derivatives include rosin acid esters with polyhydric alcohols, including rosin triglycerides. Preferably, the polyhydric alcohols have a molecular weight of less than about 1000, preferably less than about 500 and particularly less than about 300. As a result, the phrase "rosin acid and/or rosin acid derivatives" is intended to include rosin acids alone, esters of such rosin acids with polyhydric alcohols, particularly polyhydric alcohols having a molecular weight of less than about 1000, preferably less than about 500 and especially less than about 300, and mixtures of these acids and esters.

In accordance with one embodiment of the present invention, the collector mixture of the present invention consists essentially of (1) a fatty acid component comprising fatty acids and/or fatty acid derivatives and (2) a rosin acid component comprising rosin acids and/or rosin acid derivatives. The collector mixture has anywhere from 25 to 90% by weight of the fatty acid component comprising fatty acids and/or fatty acid derivatives and has anywhere from 5 to 65% by weight of the rosin acid component comprising rosin acids and/or rosin acid derivatives. In this embodiment, the collector mixture has less than 18% by weight of other non-fuel oil (tall oil derived) components (i.e., the unsaponifiable constituents of tall oil). Recall that the collector mixture of the present invention is substantially free of fuel oil. Preferably, in this embodiment of the invention the collector mixture of the present invention consisting essentially of a fatty acid component of fatty acids and/or fatty acid derivatives and a rosin acid component of rosin acids and/or rosin acid derivatives has from 50 to 85% by weight of the fatty acid component of fatty acids and/or fatty acid derivatives, has from 10 to 50% by weight of the rosin acid component of rosin acids and/or rosin acid derivatives and has less than 17% by weight of other non-fuel oil components (i.e., the unsaponifiable constituents of tall oil). Usually, the collector mixture of this embodiment of the present invention has from 50 to 80% by weight of the fatty acid component of fatty acids and/or fatty acid derivatives, has from 20 to 50% by weight of the rosin acid component of rosin acids and/or rosin acid derivatives and has less than 15% by weight of other non-fuel oil components (i.e., the unsaponifiable constituents of tall oil).

As noted above, in another embodiment the present invention also contemplates using a crude tall oil or a crude tall oil equivalent. As used herein, the phrase "crude tall oil equivalent" is intended to embrace a tall oil fraction that is created by blending various distilled tall oil fractions in order to recreate the balance of the three main components that exists in crude tall oils. Thus, a tall oil fraction containing at least about 5%, often at least 8%, and more usually at least 10% by weight neutral and non-saponifiable components, from about 20-75%, more usually 30-65% fatty acids and from about 20-65%, more usually 25-60% rosin acids, when prepared by blending various distilled tall oil fraction, is considered a crude tall oil equivalent in accordance with the present invention.

One particularly suitable crude tall oil for use as a collector in accordance with the present invention, is the crude tall oil obtained as an acidified byproduct in the Kraft or sulfate processing of Southeastern U.S. pine species. The crude tall oil obtained from this wood type generally has a distribution of fatty acids, rosin acids and neutral and non-saponifiable components, respectively, in the ranges of 25-50%, 25-50% and 5-25%, all by weight.

The crude tall oil collector according to this embodiment of the present invention thus consists essentially of a mixture of tall oil fatty acids (and related esters), tall oil rosin acids (and related esters) and tall oil neutral and non-saponifiable components. The crude tall oil collector mixture has anywhere from 20 to 75% by weight of the tall oil fatty acid constituents, anywhere from 20 to 65% by weight of the tall oil rosin acid constituents and has at least 5% by weight of tall oil neutral and non-saponifiable constituents (i.e., the unsaponifiable constituents of tall oil), often at least 8% and usually at least 10% by weight tall oil neutrals and non-saponifiables. Recall that the collector mixture of the present invention is substantially free of fuel oil. In an alternative embodiment, the crude tall oil collector of the present invention consists essentially of 25-50% by weight of tall oil fatty acid constituents, 25-50% by weight of tall oil rosin acid constituents and from 5-25% by weight of tall oil neutral and non-saponifiable constituents.

As noted above, a preferred source of the collector mixture according to one embodiment of the present invention is a fraction, or a mixture of various fractions obtained during the distillation of crude tall oil. Thus, mixtures or blends of various tall oil distillate fractions may be employed as the collector material. Suitable fatty acid/rosin acid mixtures, having a desired ratio of fatty acid and rosin acids, may be obtained in a single distillate fraction by adjusting tall oil fractionation conditions. Otherwise, suitable fatty acid/rosin acid mixtures can be prepared by blending separate sources enriched in fatty acids or rosin acids. Representative tall oil distillate components, which are commercially available from Georgia-Pacific Chemicals LLC, Atlanta, Ga., and from which suitable mixtures of fatty acids and rosin acids can be prepared for use as a collector in accordance with the present invention include XTOL®100, XTOL®300, XTOL®3030, XTOL®520 and XTOL®304, DTO and XTOL®530, and LYTOR®100.

Thus, in accordance with a preferred aspect of the present invention, the fatty acid component consists essentially of fatty acids and/or fatty acid derivatives obtained or derived from tall oil and the rosin acid component consists essentially of rosin acids and/or rosin acid derivatives obtained or derived from tall oil. Other tall oil constituents (i.e., non-fatty acid components and non-rosin acid components) may constitute up to 30%, usually no mare than 25% and often no more than 20% of the tall oil derived components of the collector mixture. One useful collector consists essentially (on a tall oil component basis) from 50 to 65% by weight of tall oil fatty acid component, 20 to 35% by weight of tall oil rosin acid component and 0 to 30% by weight of tall oil neutrals (unsaponifiables). A useful collector mixture constitutes a blend of 80.0% XTOL®3030; 17.0% XTOL®520 DTO; and 3.0% XTOL®100.

Coals to be beneficiated in accordance with the present invention can suitably be anthracite, lignite, bituminous, sub-bituminous and the like. The coal is provided in a particulate form suitable for making a coal slurry. The coal can be pulverized and cleaned using any available technology. Ultimately, an aqueous slurry of finely divided coal particles having a concentration of solids which promotes rapid flotation is prepared. Generally, a solids concentration of from about 2 to about 25 weight percent coal solids, more usually from about 5 to about 15 weight percent, is suitable.

The particle size of the coal flotation feed also is an important consideration as understood by those skilled in coal beneficiation. Generally particles larger than about 28 mesh (U.S. Sieve Size) are difficult to float so all of the particles should be of a smaller size, generally smaller than a No. 30 sieve U.S. Standard Sieve Series (less than about 600 μm). Preferably, the coal particles to be treated in the process of the present invention have a particle size of less than 50 mesh (U.S. Sieve Series). More preferably, the coal particles have a particle size of less than 100 mesh.

The amount of collector suitably added to the aqueous coal slurry for obtaining the greatest recovery of combustible coal particles with an acceptable ash content is dependent upon such diverse factors as particle size, coal rank and degree of surface oxidation and the initial ash content of the coal feed, as well as the loading of frothing agent and other adjuvants. Generally, a suitable loading of the collector mixture can be determined by routine experiments. The phrase "effective amount" when used throughout the specification and claims is intended to denote the amount of the collector required to increase the recovery (yield) of ash-reduced coal by froth flotation in the presence of a frothing agent. Generally, when the collector mixture is employed with only a frothing agent, the collector is advantageously employed in a ratio of from about 0.001 to about 0.4 percent by weight, and more preferably from about 0.005 to about 0.1 percent by weight of coal solids fed to the flotation process, i.e., 0.1 to 2 pounds of collector per ton of coal).

The fatty acid/rosin acid collector mixture of the present invention, whether a crude tall oil or a designed mixture of fatty acids and rosin acids (or certain derivatives of fatty acids and rosin acids), particularly a mixture derived from tall oil, should be used in combination with a frothing agent. A frothing agent is used to promote formation of a suitably structured froth. Conventional frothing agents include pine oils, cresol, 2-ethyl hexanols, aliphatic alcohols such as isomers of amyl alcohol and other branched $C_4$ to $C_8$ alkanols, polypropylene glycols and ethers, methyl cyclohexyl methanols, and the like. Particularly suitable as frothing agents are methyl isobutyl carbinol (MIBC) and polypropylene glycol alkyl or phenyl ethers. The optimal amount of frothing agent to use in the flotation medium also is influenced by a number of factors, most important of which is the particle size, rank and degree of oxidation of the coal. Generally, an amount of from about 0.001 to 0.1 percent by weight frothing agent per weight of coal feed solids is suitable, more usually from 0.01 to 0.05 percent by weight.

The collector mixture of the present invention also can be used in combination with other environmentally acceptable (non-fuel oil) adjuvants and other additives that do not change the basic and novel characteristic of the environmentally friendly collector mixture, such as activators, conditioning reagents, dispersing reagents, depressing reagents, pour point depressants and freezing point depressants. As noted earlier, it is a critical feature of the present invention that conventional fuel oil collectors are not employed in the flotation medium and/or as a dispersing reagent.

The addition of a pour point depressant or a freezing point depressant to the collector mixture of the present invention is particularly useful in cold climates for maintaining the fluidity of the collector mixture. Suitable materials include fatty acids esters, particularly when esterified with a low molecular weight alcohol like ethanol or methanol, poly alkyl acrylates, poly alkyl methacrylates, copolymers of styrene and dialkyl maleates, copolymers of styrene and dialkyl fumarates, copolymers of styrene and alkyl acrylates, copolymers of styrene and alkyl methacrylates, alkylphenoxy poly(ethylene oxide) ethanol, alkylphenoxy poly(propylene oxide) propane diol, propylene glycol, ethylene glycol, diethylene glycol, acetate salts, acetate esters, chloride salts, formate esters, formate salts, glycerin, diesters of diacids, copolymers of dialkyl fumarates and vinyl acetate, copolymers of dialkyl maleate and vinyl acetate, copolymers of alkyl acrylate and vinyl acetate, copolymers of alkyl methacrylate and vinyl acetate, and the like usually in an amount of 5-60%, often 5-50% and usually 5-40%, by weight of the total solids in the collector mixture.

The aqueous coal slurry is desirably treated with the frothing agent and the collector of the present invention and any other adjuvants by vigorously mixing or agitating the slurry prior to flotation in a conventional manner. Generally for coal that is more difficult to float, it may be beneficial to mix the coal slurry with the collector for a period of time prior to flotation, so as to obtain an intimate contact of the collector with substantially all of the coal.

The coal is generally floated at the natural pH of the aqueous coal slurry, which usually can vary from about 3.0 to about 9.5 depending upon the composition of the feed. However, the pH can optionally be adjusted to maintain the pH of the aqueous coal slurry prior to and during flotation at a value of from about 4 to about 9, more usually from about 5.5 to about 9. A pH in this range appears to promote a suitable level of coal recovery. If the coal is acidic in character, the pH can be adjusted using an alkaline material, such as soda ash, lime, ammonia, potassium hydroxide or magnesium hydroxide, with sodium hydroxide being preferred. If the aqueous coal slurry is alkaline in character, a carboxylic acid, such acetic acid and the like, or a mineral acid, such as sulfuric acid, hydrochloric acid and the like, can be used to adjust the pH, if desired.

The collector-treated and pH-adjusted aqueous coal slurry then is aerated in a conventional flotation machine or bank of rougher cells to float the coal. Any conventional rougher flotation unit can be employed and the present invention is not limited to any particular design of flotation equipment.

In further embodiments, the present invention is:

1. A froth flotation process for the beneficiation of coal, which process comprises the steps of (a) forming an aqueous slurry of the coal, (b) adding an effective amount of a collector consisting essentially of a mixture of (1) a fatty acid component comprising fatty acids, fatty acid derivatives, or a mixture thereof and (2) a rosin acid component comprising rosin acids, rosin acid derivatives, or a mixture thereof, (c) subjecting the aqueous slurry of coal containing the collector to froth flotation, and (d) separating the floated material comprising the beneficiated coal.

2. A froth flotation process for the beneficiation of coal, which process comprises the steps of (a) forming an aqueous slurry of the coal, (b) adding an effective amount of a collector consisting essentially of a mixture of (1) a fatty acid component comprising fatty acids, fatty acid derivatives, or a mixture thereof and (2) a rosin acid component comprising rosin acids, rosin acid derivatives, or a mixture thereof, where fatty acid component (1) constitutes 25 to 90% by weight of the mixture; rosin acid component (2) constitutes 5 to 65% by weight of the mixture and the collector contains less than 18% of other non-fuel oil components, (c) subjecting the aqueous slurry of coal containing the collector to froth flotation, and (d) separating the floated material comprising the beneficiated coal.

3. A froth flotation process for the beneficiation of coal, which process comprises the steps of (a) forming an aqueous slurry of the coal, (b) adding an effective amount of a collector consisting essentially of a mixture of (1) a fatty acid component comprising fatty acids, fatty acid derivatives, or a mixture thereof and (2) a rosin acid component comprising rosin acids, rosin acid derivatives, or a mixture thereof, wherein the fatty acid component (1) constitutes 50 to 85% by weight of the mixture, the rosin acid component (2) constitutes 10 to 50% by weight of the mixture and the collector contains less than 17% of other non-fuel oil components, (c) subjecting the aqueous slurry of coal containing the collector to froth flotation, and (d) separating the floated material comprising the beneficiated coal.

4. A froth flotation process for the beneficiation of coal, which process comprises the steps of (a) forming an aqueous slurry of the coal, (b) adding an effective amount of a collector consisting essentially of a mixture of (1) a fatty acid component comprising fatty acids, fatty acid derivatives, or a mixture thereof and (2) a rosin acid component comprising rosin acids, rosin acid derivatives, or a mixture thereof, wherein the fatty acid component (1) constitutes 50 to 80% by weight of the mixture, the rosin acid component (2) constitutes 20 to 50% by weight of the mixture and the collector contains less than 15% of other non-fuel oil components, (c) subjecting the aqueous slurry of coal containing the collector to froth flotation, and (d) separating the floated material comprising the beneficiated coal.

5. A froth flotation process for the beneficiation of coal, which process comprises the steps of (a) forming an aqueous slurry of coal particles, (b) adding an effective amount of a collector consisting essentially of a crude tall oil or a crude tall oil equivalent to the aqueous slurry of coal, (c) subjecting the aqueous slurry of coal containing the collector to froth flotation, and (d) separating the floated material comprising the beneficiated coal.

6. A froth flotation process for the beneficiation of coal, which process comprises the steps of (a) forming an aqueous slurry of coal particles, (b) adding an effective amount of a collector consisting essentially of a crude tall oil or a crude tall oil equivalent to the aqueous slurry of coal, wherein the crude tall oil or crude tall oil equivalent has from 20 to 75% by weight of tall oil fatty acid constituents, from 20 to 65% by weight of tall oil rosin acid constituents and at least 5% by weight of tall oil neutral and non-saponifiable constituents, (c) subjecting the aqueous slurry of coal containing the collector to froth flotation, and (d) separating the floated material comprising the beneficiated coal.

7. A froth flotation process for the beneficiation of coal, which process comprises the steps of (a) forming an aqueous slurry of coal particles, (b) adding an effective amount of a collector consisting essentially of a crude tall oil or a crude tall oil equivalent to the aqueous slurry of coal, wherein the crude tall oil or crude tall oil equivalent has from 25 to 50% by weight of tall oil fatty acid constituents, from 25 to 50% by weight of tall oil rosin acid constituents and from 5 to 25% by weight of tall oil neutral and non-saponifiable constituents, (c) subjecting the aqueous slurry of coal containing the collector to froth flotation, and (d) separating the floated material comprising the beneficiated coal.

8. A method according to any of the previous embodiments wherein said aqueous slurry of coal contains 2 to 25 weight percent solids; wherein the particle size of said coal is less than 100 mesh; and wherein said collector is added at a level of about 0.005 to 0.1 percent by weight of coal solids.

9. A method according to any of the previous embodiments wherein a frothing agent is added to the aqueous slurry of coal.

10. A method according to any of the previous embodiments wherein the frothing agent is selected from the group consisting of methylisobutylcarbinol, pine oils, cresol, 2-ethyl hexanols, aliphatic alcohols, methyl cyclohexyl methanols, polypropylene glycols and polypropylene glycol alkyl or phenyl ethers.

11. A method according to any of the previous embodiments wherein said frothing agent is added at a level of about 0.01 to 0.05 percent by weight of coal solids.

12. A method according to any of the previous embodiments wherein the fatty acid component consists essentially of tall oil derived material.

13. A method according to any of the previous embodiments wherein the rosin acid component consists essentially of tall oil derived material.

14. A method according to any of the previous embodiments wherein the collector consists essentially of 50 to 65% by weight of tall oil fatty acid component, 20 to 35% by weight of tall oil rosin acid component and 0 to 30% by weight of tall oil neutrals 15. A method according to any of the previous embodiments wherein the collector contains from 5 to 60% by weight of a pour point depressant or a freezing point depressant.

The following examples provide illustrative embodiments of the present invention and are not intended as a limitation on the scope of the invention. Unless otherwise indicated, all parts and percentages are by weight.

Example 1

In a first series of substantially identical flotation tests conducted consistent with ASTM D 5114-90, Standard Test Method for Laboratory Froth Flotation of Coal in a Mechanical Cell, several different collector compositions were examined. The various collectors were added to an aqueous coal slurry in an amount of 0.50 pound of collector per ton of coal (an amount of 0.025 percent by weight of coal solids) and the resulting slurries were introduced into a flotation cell (Denver Laboratory Flotation Test Cell).

In each of these tests, approximately 100 grams of the same comminuted coal source or sample was diluted with prep. plant water to a slurry concentration of 5 percent solids by weight. The coal was a lower banner from Alpha Natural Resources (bituminous steam or met.) coal. The coal feed consisted essentially of particles smaller than about 100 mesh, U.S. standard sieve series. The same frothing agent, methyl cyclohexyl methanol (Surflot 944), was used in each of the tests at a level of 10 ppm. The pH was measured to be about 6.9.

Three separate series of tests were conducted, two at a float time of 3 minutes and one using a float time of 2 minutes. The weights and ash contents of the overhead, flotation concentrate (conc.) and of the tailings (tails) were measured and the percentage of the overall combustible material recovered in the concentrate (% comb. recovery) was calculated for each of the collectors. The results are presented in Table 1. Table 1 thus tabulates the identity of the collector for each run as well as the percent recovery of combustible coal and the ash content in the recovered concentrate.

TABLE 1

| Collector Tested | float time | mass (g) conc. | mass (g) tails | conc. % ash | tails % ash | % comb. recovery |
|---|---|---|---|---|---|---|
| Fuel Oil | 3 min. | 70.5 | 29.5 | 14.61 | 91.44 | 95.97 |
| XTOL ® 656 | 3 min. | 70.4 | 29.6 | 14.70 | 92.24 | 96.32 |
| 50 wt. % TOFA/50 wt. % Rosin Triglyceride | 3 min. | 70.2 | 29.8 | 14.14 | 91.04 | 95.76 |
| Fuel Oil | 3 min. | 60.9 | 39.1 | 13.48 | 88.50 | 92.14 |
| XTOL ® 656 | 3 min. | 62.4 | 37.6 | 15.58 | 87.95 | 92.08 |
| 50 wt. % TOFA/50 wt. % Rosin Triglyceride | 3 min. | 61.2 | 38.8 | 13.57 | 88.19 | 92.03 |
| Fuel Oil | 2 min. | 63.8 | 36.2 | 10.93 | 85.14 | 91.35 |
| XTOL ® 656 | 2 min. | 67.1 | 32.9 | 11.41 | 89.74 | 94.63 |

TABLE 1-continued

| Collector Tested | float time | mass (g) conc. | mass (g) tails | conc. % ash | tails % ash | % comb. recovery |
|---|---|---|---|---|---|---|
| 50 wt. % TOFA/50 wt. % Rosin Triglyceride | 2 min. | 62.8 | 37.2 | 11.02 | 82.96 | 89.81 |

XTOL®656 is a commercial tall oil blended product available from Georgia-Pacific Chemicals LLC, Atlanta, Ga. containing about 25% by weight rosin acids and 60% by weight tall oil fatty acids. The rosin triglyceride was prepared using LYTOR®100 also commercially available from Georgia-Pacific Chemicals LLC, Atlanta, Ga.

The tests results show that the fatty acid/rosin blends of the present invention provide a comparable degree of beneficiation when compared to a standard fuel oil collector. Indeed, in these tests XTOL®656 was consistently as good as, or better than fuel oil.

Example 2

In a second series of substantially identical flotation tests conducted consistent with ASTM D 5114-90, Standard Test Method for Laboratory Froth Flotation of Coal in a Mechanical Cell, another set of collector compositions were examined. As in Example 1, the various collectors were again added to an aqueous coal slurry in an amount of 0.50 pound of collector per ton of coal (an amount of 0.025 percent by weight of coal solids) and the resulting slurries were introduced into the same flotation equipment used in the tests of Example 1.

In each of these tests, approximately 100 grams of the same comminuted coal sample was diluted with prep. plant water to a slurry concentration of 5 percent solids by weight. The same coal source used in example 1 was used. The coal feed consisted essentially of particles smaller than about 100 mesh, U.S. standard sieve series. The same frothing agent, Shurflot 944, was used in each of the tests at a level of 10 ppm.

In this Example, two separate series of tests were conducted, one at a float time of 3 minutes and one using a float time of 2 minutes. The weights and ash contents of the overhead, flotation concentrate and of the tailings were measured and the percentage of the overall combustible material recovered in the concentrates was calculated for each of the collectors. The results are presented in Table 2. Table 2 thus tabulates the identity of the collector for each run as well as the percent recovery of combustible coal and the ash content in the recovered concentrate.

TABLE 2

| Product Tested | float time | mass (g) Conc. | mass (g) tails | conc. ash (%) | Tails ash (%) | % comb. recovery |
|---|---|---|---|---|---|---|
| NONE | 3 min. | 48.6 | 51.4 | 12.56 | 70.51 | 73.71 |
| Fuel Oil | 3 min. | 55.1 | 44.9 | 8.93 | 83.65 | 87.24 |
| XTOL ® 656 | 3 min. | 59.5 | 40.5 | 11.61 | 86.98 | 90.89 |
| XTOL ® 656/LYTOR ® 100 BLEND with 50 wt. % Rosin* | 3 min. | 58.8 | 41.2 | 11.87 | 86.29 | 90.17 |
| TOFA/25 wt. % Rosin | 3 min. | 58.4 | 41.6 | 11.83 | 85.58 | 89.57 |
| NONE | 2 min. | 40.5 | 59.5 | 10.97 | 63.85 | 62.64 |
| Fuel Oil | 2 min. | 51.2 | 48.8 | 7.73 | 78.47 | 81.81 |
| XTOL ® 656 | 2 min. | 58.8 | 41.2 | 11.41 | 86.14 | 90.12 |
| XTOL ® 656/LYTOR ® 100 BLEND with 50 wt. % Rosin* | 2 min. | 58.7 | 41.3 | 11.62 | 85.93 | 89.93 |
| TOFA/25 wt. % Rosin | 2 min. | 57.2 | 42.8 | 11.03 | 84.31 | 88.34 |

*Sample had to be heated to add collector to slurry

The tests results show that the fatty acid/rosin blends of the present invention provide a comparable degree of beneficiation when compared to a standard fuel oil collector. Indeed, in these tests the blends of fatty acid and rosin acids were consistently as good as, or better than fuel oil in the yield of combustible coal.

Example 3

In another set of substantially identical flotation tests conducted consistent with ASTM D 5114-90, Standard Test Method for Laboratory Froth Flotation of Coal in a Mechanical Cell, a crude tall oil collector was compared with a conventional fuel oil collector. The collectors were added to an aqueous coal slurry in an amount of 0.50 pound of collector per ton of coal (an amount of 0.025 percent by weight of coal solids) and the resulting slurries were introduced into a flotation cell (Denver Laboratory Flotation Test Cell).

In each test, approximately 100 grams of the same comminuted coal source or sample was diluted with prep. plant water to a slurry concentration of 5 percent solids by weight. The coal was a lower banner from Alpha Natural Resources (bituminous steam or met.) coal. The coal feed consisted essentially of particles smaller than about 100 mesh, U.S. standard sieve series. The same frothing agent, methyl cyclohexyl methanol (Surflot 944), was used in each of the tests at a level of 10 ppm. The pH was measured to be about 6.9.

Two separate tests were conducted, one at a float time of 3 minutes and one using a float time of 2 minutes. The weights and ash contents of the overhead, flotation concentrate (conc.) and of the tailings (tails) were measured and the percentage of the overall combustible material recovered in the concentrate (% comb. recovery) was calculated for each of the collectors. The results are presented in Table 1. Table 1 thus tabulates the identity of the collector for each run as well as the percent recovery of combustible coal and the ash content in the recovered concentrate.

TABLE 3

| Collector Tested | float time | Mass (g) conc. | mass (g) tails | conc. % ash | tails % ash | % comb. recovery |
|---|---|---|---|---|---|---|
| Fuel Oil | 3 min. | 55.1 | 44.9 | 8.93 | 83.65 | 87.24 |
| CTO | 3 min. | 59.3 | 40.7 | 11.69 | 86.42 | 90.45 |
| Fuel Oil | 3 min. | 51.2 | 48.8 | 7.73 | 78.47 | 81.81 |
| CTO | 3 min. | 58.2 | 41.8 | 11.56 | 85.24 | 89.30 |

The tests results show that CTO collector of the present invention provides at least a comparable degree of beneficiation when compared to a standard fuel oil collector.

The present invention has been described with reference to specific embodiments. However, this application is intended to cover those changes and substitutions that may be made by those skilled in the art without departing from the spirit and the scope of the invention. Unless otherwise specifically indicated, all percentages are by weight. Throughout the specification and in the claims the term "about" is intended to encompass + or −5% and preferably is only about + or −2%.

What is claimed is:

1. A froth flotation process, comprising:

combining a collector and an aqueous slurry to produce a treated mixture, wherein the aqueous slurry comprises particles, and wherein the collector comprises:

a fatty acid component comprising fatty acids, fatty acid derivatives, or a mixture thereof, a rosin acid component comprising rosin acids, rosin acid derivatives, or a mixture thereof, and at least 5 wt % of a non-saponifiable component, based on the combined weight of the fatty acid component, the rosin acid component, and the non-saponifiable component;

aerating the treated mixture to produce an aerated mixture, wherein the treated mixture is substantially free of fuel oil when the treated mixture is aerated; and recovering a beneficiated product from the aerated mixture, wherein the particles comprise coal particles.

2. The process of claim 1, wherein the collector comprises at least 5 wt % to about 25 wt % of the non-saponifiable component, based on the combined weight of the fatty acid component, the rosin acid component, and the non-saponifiable component.

3. The process of claim 1, wherein the collector comprises at least 8 wt % to about 25 wt % of the non-saponifiable component, based on the combined weight of the fatty acid component, the rosin acid component, and the non-saponifiable component.

4. The process of claim 1, wherein the particles further comprise ash particles.

5. The process of claim 4, wherein the beneficiated product comprises at least a portion of the coal particles, and wherein the beneficiated product has a reduced concentration of the ash particles relative to the coal particles as compared to the particles in the aqueous slurry.

6. The process of claim 1, wherein the treated mixture comprises about 0.001 wt % to about 0.4 wt % of the collector, based on the total weight of the particles.

7. The process of claim 1, wherein the treated mixture comprises about 0.001 wt % to about 0.1 wt % of the collector, based on the total weight of the particles.

8. The process of claim 1, wherein the collector comprises about 25 wt % to about 90 wt % of the fatty acid component, about 5 wt % to about 65 wt % of the rosin acid component, and less than 18 wt % of the non-saponifiable component, based on the combined weight of the fatty acid component, the rosin acid component, and the non-saponifiable component.

9. The process of claim 1, wherein the particles comprise a mixture of coal particles and ash particles, wherein the collector comprises about 25 wt % to about 90 wt % of the fatty acid component, about 5 wt % to about 65 wt % of the rosin acid component, and less than 18 wt % of the non-saponifiable component, based on the combined weight of the fatty acid component, the rosin acid component, and the non-saponifiable component, wherein the beneficiated product comprises at least a portion of the coal particles, and wherein the beneficiated product has a reduced concentration of the ash particles relative to the coal particles as compared to the particles in the aqueous slurry.

10. The process of claim 1, wherein the collector comprises the fatty acid derivatives, the rosin acid derivatives, or a mixture of the fatty acid derivatives and the rosin acid derivatives, wherein the fatty acid derivatives comprise fatty acid monoesters with polyhydric alcohols, fatty acid diesters with polyhydric alcohols, or a mixture thereof, and wherein the rosin acid derivatives comprise disproportionated rosin acids, rosin acid esters with polyhydric alcohols, or a mixture thereof.

11. The process of claim 1, further comprising adding a frothing agent to the collector and the aqueous slurry to produce the treated mixture.

12. A froth flotation process, comprising:

combining a collector and an aqueous slurry to produce a treated mixture, wherein the aqueous slurry comprises particles, and wherein the collector comprises fatty acids, rosin acids, and at least 5 wt % of a non-saponifiable component, based on the combined weight of the fatty acids, the rosin acids, and the non-saponifiable component; and subjecting the treated mixture to froth flotation to produce a beneficiated product, wherein the treated mixture is substantially free of fuel oil when the treated mixture is subjected to froth flotation, wherein the particles comprise coal particles.

13. The process of claim 12, wherein the collector comprises at least 5 wt % to about 25 wt % of the non-saponifiable component, based on the combined weight of the fatty acid component, the rosin acid component, and the non-saponifiable component.

14. The process of claim 12, wherein the particles further comprise ash particles.

15. The process of claim 12, wherein the particles comprise coal particles and ash particles, wherein the collector comprises about 25 wt % to about 90 wt % of the fatty acids, about 5 wt % to about 65 wt % of the rosin acids, and less than 18 wt % of the non-saponifiable component, based on the combined weight of the fatty acids, the rosin acids, and the non-saponifiable component, wherein the beneficiated product comprises at least a portion of the coal particles, and wherein the beneficiated product has a reduced concentration of the ash particles relative to the coal particles as compared to the particles in the aqueous slurry.

16. The process of claim 12, further comprising adding a frothing agent to the collector and the aqueous slurry to produce the treated mixture, wherein the frothing agent comprises methyl isobutyl carbinol, a pine oil, a cresol, 2-ethylhexanol, an aliphatic alcohol, a methyl cyclohexyl methanol, a polypropylene glycol, a polypropylene glycol alkyl ether, or a polypropylene glycol phenyl ether.

17. A froth flotation process, comprising:

combining a collector and an aqueous slurry to produce a treated mixture, wherein the aqueous slurry comprises coal particles and ash particles, and wherein the collector comprises a fatty acid component, a rosin acid component, and at least 5 wt % of a non-saponifiable component, based on the combined weight of the fatty acid component, the rosin acid component, and the non-saponifiable component;

aerating the treated mixture comprising the collector and the aqueous slurry to produce an aerated mixture, wherein the treated mixture is substantially free of fuel oil when the treated mixture is aerated; and recovering a beneficiated product comprising at least a portion of the coal particles from the aerated mixture, wherein the beneficiated product has a reduced concentration of the ash particles relative to the coal particles as compared to the coal particles and the ash particles in the aqueous slurry.

18. The process of claim 17, wherein the collector comprises about 25 wt % to about 90 wt % of the fatty acid component, about 5 wt % to about 65 wt % of the rosin acid component, and less than 18 wt % of the non-saponifiable component, based on the combined weight of the fatty acid component, the rosin acid component, and the non-saponifiable component.

19. The process of claim 17, wherein the coal particles comprise anthracite coal, lignite coal, bituminous coal, or sub-bituminous coal, wherein the ash particles comprise non-combustible mineral matter, wherein the collector comprises about 25 wt % to about 90 wt % of the fatty acid component, about 5 wt % to about 65 wt % of the rosin acid component, and less than 18 wt % of the non-saponifiable component, based on the combined weight of the fatty acid component, the rosin acid component, and the non-saponifiable component, and wherein the treated mixture comprises about 0.001 wt % to about 0.4 wt % of the collector, based on the combined weight of the coal particles and the ash particles.

20. The process of claim 17, further comprising adding a frothing agent to the collector and the aqueous slurry to produce the treated mixture, wherein the frothing agent comprises methyl isobutyl carbinol, a pine oil, a cresol, 2-ethylhexanol, an aliphatic alcohol, a methyl cyclohexyl methanol, a polypropylene glycol, a polypropylene glycol alkyl ether, or a polypropylene glycol phenyl ether, wherein the collector comprises less than 18 wt % of the non-saponifiable component, based on the combined weight of the fatty acid component, the rosin acid component, and the non-saponifiable component, and wherein the treated mixture comprises about 0.001 wt % to about 0.1 wt % of the collector, based on the combined weight of the coal particles and the ash particles.

* * * * *